US008603376B1

(12) United States Patent
Sands et al.

(10) Patent No.: US 8,603,376 B1
(45) Date of Patent: Dec. 10, 2013

(54) RAILROAD DIRECT FIXATION TIE COVERING SYSTEM

(76) Inventors: Thomas Sands, Yardley, PA (US); Jonathan Barnhart, Riverdale, NJ (US)

( * ) Notice: Subject to any disclaimer, the term of this patent is extended or adjusted under 35 U.S.C. 154(b) by 256 days.

(21) Appl. No.: 13/169,342

(22) Filed: Jun. 27, 2011

(51) Int. Cl.
*E04B 1/16* (2006.01)

(52) U.S. Cl.
USPC ..... 264/31; 264/33; 264/34; 264/35; 264/228; 249/1; 249/2; 249/86; 249/91; 249/188; 249/189; 249/207; 238/1; 238/8; 238/9; 238/25; 238/30; 238/162; 238/265; 104/2; 104/7.3; 104/8; 104/11

(58) Field of Classification Search
USPC ..... 264/31, 33, 34, 35, 36.2, 426, 228, 264/297.9, 37.19, 133; 249/1, 2, 86, 91, 249/188, 189, 207; 238/1, 8, 9, 25, 30, 162, 238/225; 104/2, 7.3, 8, 11
See application file for complete search history.

(56) References Cited

U.S. PATENT DOCUMENTS

| | | | | | |
|---|---|---|---|---|---|
| 512,343 | A * | 1/1894 | Warren | 238/9 |
| 690,988 | A * | 1/1902 | Nelson | 238/9 |
| 760,983 | A * | 5/1904 | Gribble | 238/7 |
| 826,344 | A * | 7/1906 | Melaun | 238/9 |
| 858,959 | A * | 7/1907 | Crenshaw | 238/9 |
| 1,034,504 | A * | 8/1912 | Pindell | 238/9 |
| 1,042,255 | A * | 10/1912 | O'Gorman | 238/53 |
| 1,149,167 | A * | 8/1915 | Schmidt | 238/9 |
| 1,349,451 | A * | 8/1920 | Godwin | 238/9 |
| 1,407,436 | A * | 2/1922 | Newell | 238/9 |
| 1,471,251 | A * | 10/1923 | Falk | 238/115 |
| 1,566,246 | A * | 12/1925 | Bramley | 238/9 |
| 1,672,752 | A * | 6/1928 | Coppock | 238/8 |
| 1,689,278 | A * | 10/1928 | Crabbs | 238/8 |
| 1,689,300 | A * | 10/1928 | Rogers | 238/8 |
| 1,693,878 | A * | 12/1928 | Wells | 238/9 |
| 1,745,745 | A * | 2/1930 | Day | 238/7 |
| 1,745,746 | A * | 2/1930 | Day | 238/7 |
| 2,045,253 | A * | 6/1936 | Saurer | 238/9 |
| 2,076,469 | A * | 4/1937 | Lehecka et al. | 238/9 |
| 2,269,906 | A * | 1/1942 | Gizzi | 238/7 |
| 3,317,137 | A * | 5/1967 | Harmon | 238/8 |
| 3,695,574 | A | 10/1972 | Charlier et al. | |
| 4,174,066 | A * | 11/1979 | Dugasz | 238/7 |
| 4,899,933 | A * | 2/1990 | Martin | 238/8 |
| 4,947,756 | A * | 8/1990 | Kusel et al. | 104/2 |
| 5,181,657 | A * | 1/1993 | Davis | 238/8 |
| 5,268,137 | A | 12/1993 | Scott et al. | |
| 5,285,964 | A * | 2/1994 | Vanotti | 238/7 |
| 5,464,152 | A * | 11/1995 | Wabnitz | 238/8 |
| 5,609,294 | A | 3/1997 | Lucas, Jr. | |
| 6,016,968 | A * | 1/2000 | Brookhart et al. | 238/2 |
| 6,354,512 | B2 * | 3/2002 | Vennell | 238/2 |
| 6,427,925 | B1 * | 8/2002 | Gaudet | 238/8 |
| 7,533,499 | B2 | 5/2009 | Daigger et al. | |
| 2004/0182946 | A1 * | 9/2004 | Reichel et al. | 238/5 |
| 2007/0034705 | A1 * | 2/2007 | Gray, Jr. | 238/8 |

* cited by examiner

*Primary Examiner* — Timothy Kennedy
(74) *Attorney, Agent, or Firm* — Goldstein Law Offices, P.C.

(57) ABSTRACT

A method and an apparatus for the protection of a railroad rail, a direct fixation plate or another support unit, a rail to rail connection and a rail to plate connection contacting with concrete upon placing of concrete during construction. The method comprises a step of disposing a mask over a railroad track having a railroad rail, a rail connector and a rail tie to protect the railroad track while placing concrete, the mask configured to cover the rail connector and tie. The mask has a connecting portion, a central portion, an extending portion configured to mask an upper longitudinally extending portion of a railroad rail, and at least one perpendicular section disposed to cover a railroad tie, direct fixation plate or other support unit.

14 Claims, 10 Drawing Sheets

RAILROAD DIRECT FIXATION TIE COVERING SYSTEM

BACKGROUND OF THE INVENTION

The invention relates generally to a railroad rail and tie covering system including a method and apparatus for installation of direct fixation track, and more specifically to a manner of masking portions of a railroad assembly for concrete installation.

Railroad tracks typically comprise rails, tie plates, rail to rail connections, rail to tie plate connections, timber ties or pre-stressed concrete ties, ballast, and an underlying subgrade. Typically, flat-bottom steel rails are welded together and supported on timber ties or pre-stressed concrete ties and laid on crushed stone ballast. The railroad rail is typically held to the tie or plate with spikes or other fasteners or connectors. Rails are restrained by tie plates, and attached to the ties to spread the load of the locomotive and rail cars traveling across them.

A specialized installation type of railroad track is direct fixation track. In these installations, the rails, plates, and timber ties are supported and surrounded by a concrete slab. These direct fixation plates have many different configurations depending on the loads carried, the frequency of traffic, the type of rail, rail to plate fasteners, noise and vibration requirements and operating railroad preferences.

A second type of direct fixation track is to support the rail and tie plate directly on a concrete slab, plinth or curb structure without the use of a tie. The tie plate, normally attached to a timber or concrete tie is instead attached directly to the concrete slab or plinth. These direct fixation plates have many different configurations depending on the loads carried, the frequency of traffic, the type of rail, rail to plate fasteners, noise and vibration requirements and operating railroad preferences. Generally, these fastener plates are attached to the concrete through the use of embedded metal studs which are bolted to the concrete.

In another application, the fastener assembly is a separate concrete mono-block tie unit which is attached to the rails and then encased in additional support concrete. The design of these mono-block tie units are also driven by the loads carried, the frequency of traffic, the type of rail, rail to plate fasteners, noise and vibration requirements and operating railroad preferences.

In all direct fixation trackwork, the rails, tie (mono-block or timber) plates, rail to rail connections, rail to tie plate connections, timber or pre-stressed concrete ties, or separate concrete tie units are supported by other means prior to concrete operations.

What is needed is a method or apparatus for installing or trackwork, particularly direct fixation track that minimizes disruption to railroad operations. While some units may be suitable for the particular purpose employed, or for general use, they would not be as suitable for the purposes of the present invention as disclosed hereafter.

SUMMARY OF THE INVENTION

It is an object of the invention to produce a method of protecting a railroad rail, a direct fixation plate or another support unit, a rail to rail connection and a rail to plate connection when placing concrete during construction. Accordingly, the method includes a step of disposing a mask over the railroad rail, the direct fixation plate or another support unit, the rail to rail connection and the rail to plate connection wherein the mask is configured and disposed to mask the railroad rail, the direct fixation plate or another support unit, the rail to rail connection and the rail to plate connection from the placing of concrete, forming the underlying support structure of direct fixation track.

It is a further object of the invention to produce a mask that prevents a railroad rail, a direct fixation plate or another support unit, a rail to rail connection and a rail to plate connection contacting with concrete upon placing of concrete during construction. Accordingly, the invention is a mask configured to be disposed to mask the railroad rail, the direct fixation plate or another support unit, the rail to rail connection and the rail to plate connection, having a connecting portion, a central portion, and an extending portion configured to mask an upper longitudinally extending portion of the railroad rail and a perpendicular portion configured to mask the direct fixation plate or other support unit.

The invention is a method and an apparatus for the protection of a railroad rail, a direct fixation plate or another support unit, a rail to rail connection and a rail to plate connection contacting with concrete upon placing of concrete during construction. The method comprises a step of disposing a mask over a railroad track having a railroad rail, a rail connector and a rail tie to protect the railroad track while placing concrete, the mask configured to cover the rail connector and tie. The mask has a connecting portion, a central portion, an extending portion configured to mask an upper longitudinally extending portion of a railroad rail, and at least one perpendicular section disposed to cover a railroad tie, direct fixation plate or other support unit.

To the accomplishment of the above and related objects the invention may be embodied in the framework illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
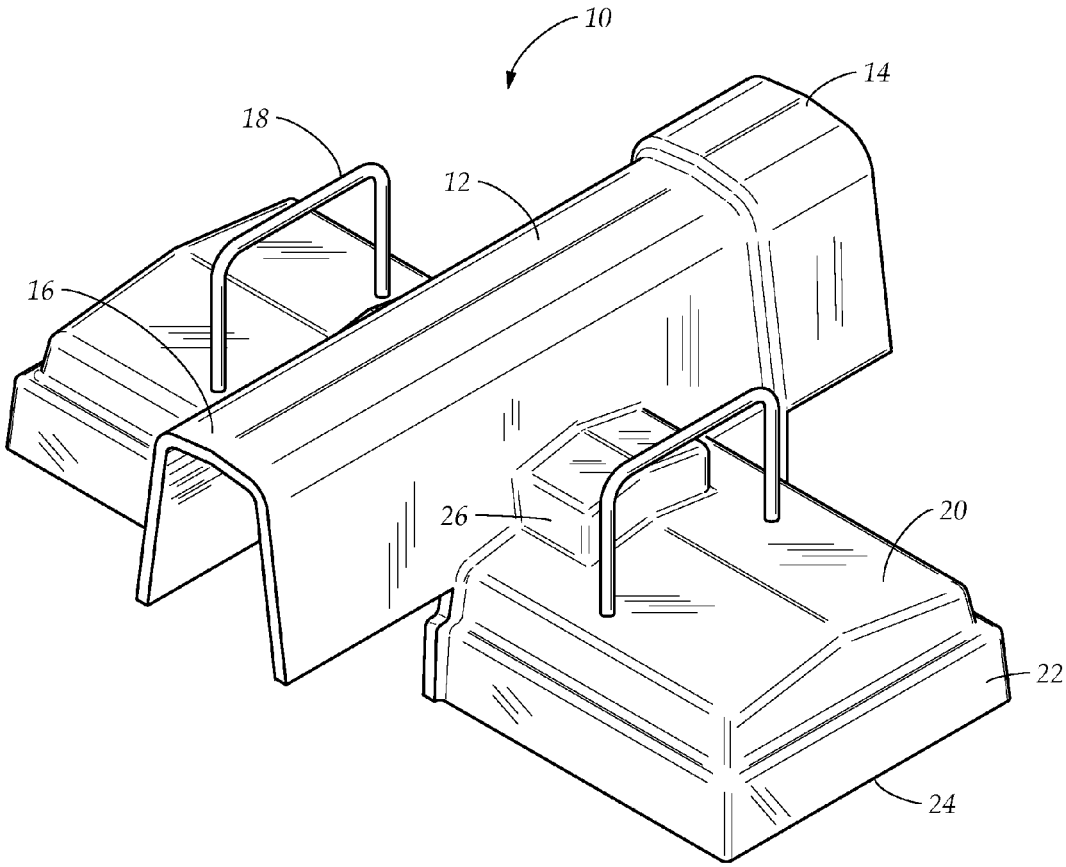
FIG. 1 is a diagrammatic perspective view of a mask of the invention from the top.
Figure 2:
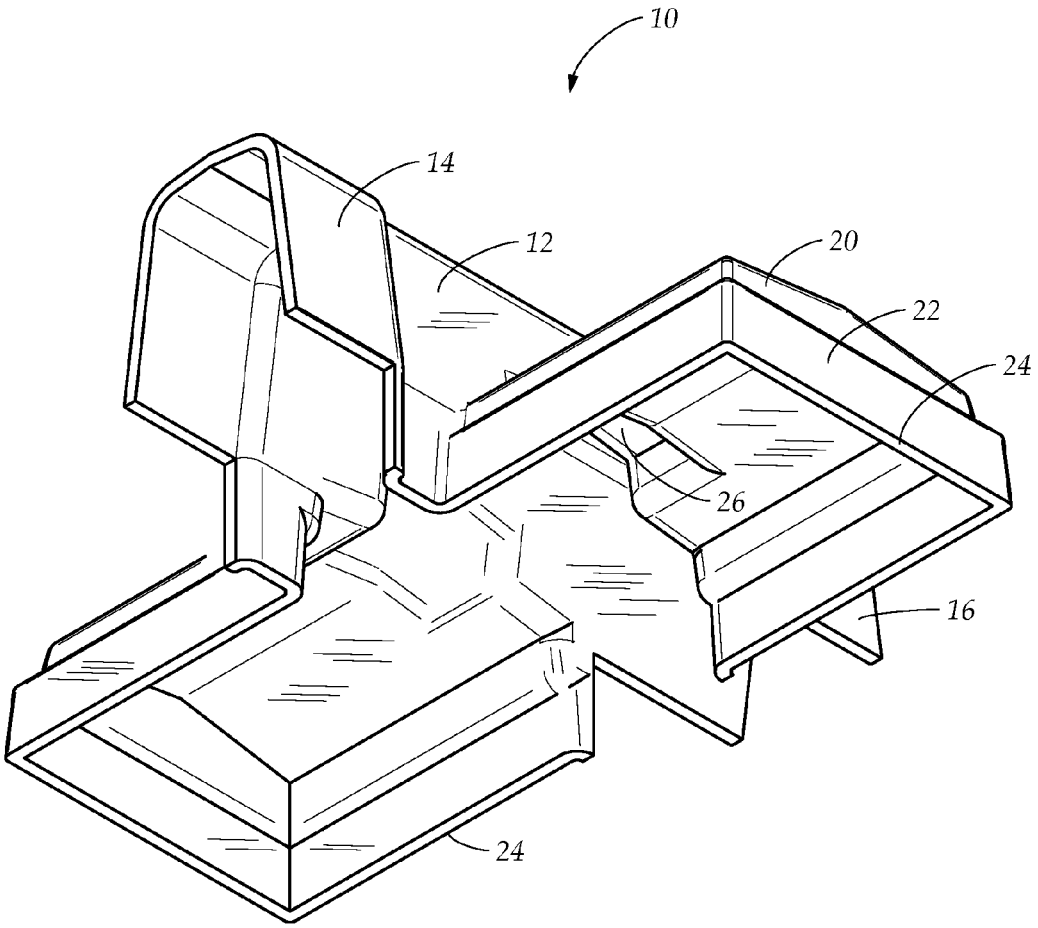
FIG. 2 is a diagrammatic perspective view of the mask from the bottom.
Figure 3:
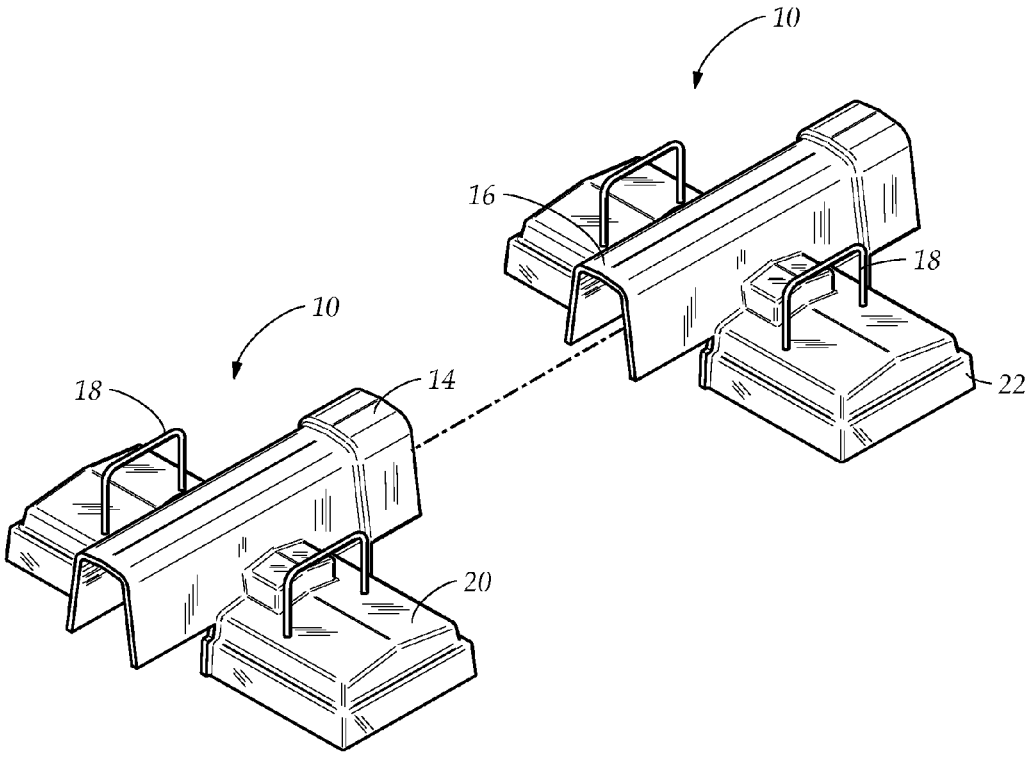
FIG. 3 is a diagrammatic perspective view from the top of a pair of masks, showing a connecting portion being configured to be disposed about an extending portion of an adjacent mask to be disposed over a rail.

Disclosed herein is a rail and tie masking system that is useful for covering a railroad track by masking portions of the railroad track prior to, during and after installation of concrete in a direct fixation track, creating an encasement around and under the track. FIG. 1, FIG. 2, and FIG. 3 illustrate a mask 10 of the present disclosure. The mask 10 is configured to be disposed over the railroad track during the placing of concrete. The mask 10 has a connecting portion 14, a central portion 12, and an extending portion 16 configured to mask an upper longitudinally extending portion of the track. The central portion 12 joins the extending portion 16 to the connecting portion 14. Connecting portion 14 is configurable to be disposed about an extending portion 16 of an adjacent mask disposed over the railroad track.

Railroad track has a plurality of rails, a plurality of ties or supports perpendicular and under the rails, and a plurality of connectors attaching the rails to the ties. When installing concrete in the direct fixation track, a concrete framework is under and around the rails.

The mask 10 also includes one or more sections configured to be disposed perpendicular to a railroad rail. For example, the mask 10 includes connector mask portion 26 configured to mask connectors such as, for example but not limited to spikes, screws, bolts, spring clips and fasteners connecting the railroad rail to the tie or base plate. The mask 10 also includes a perpendicular mask portion 20 configured to mask a base plate and/or a portion of a railroad tie or other support. Further, mask 10 includes an outer mask portion 22 which can be configured to be disposed about an outer edge of a base plate and/or mask a portion of a railroad tie or other support. Throughout this discussion the term tie refers to all types of supports used to support railroad rails.

The mask 10 has a planar bottom edge 24. Planar bottom edge 24 is configured to be disposed against an upper surface of concrete or with a plane of a lower surface of a tie. Placing concrete over and around the mask 10 into the concrete framework in an amount sufficient to contact planar bottom edge 24 of mask 10 filling the concrete framework in a plane with the lower surface of the railroad tie, creating a concrete slab.

Referring to FIG. 1, the mask 10 includes at least one handle 18 configured for disposing the mask 10 over the upper portion of the railroad rail and rail connector and removing it therefrom. Removal of mask 10 is selectively done after placing concrete about mask 10 into the concrete or after curing of the placed concrete. A single handle extends upward from mask central portion 12 or the mask 10 has a plurality of handles 18. For example, mask 10 includes a handle extending upward from each perpendicular mask portion 20 as shown in the figures. Mask 10 includes a pliable or bendable material such as a polymeric material. Pliability of mask 10 aids in the removal cured concrete on an outer surface thereof. However, hard or rigid masks are also contemplated as part of the invention and are within the inventive concept.

A method of covering railroad track components includes a step of disposing the mask 10 over an upper portion of a railroad rail and rail connector. Mask extending portion 16, mask central portion 12, and mask connecting portion 14 is disposed to mask an upper portion of a railroad rail and connector mask portion 26 is disposed to cover the rail connector. The perpendicular mask portion 20 is disposed over the tie. Upon disposing mask 10 over an upper portion of a railroad rail and rail connector it masks a portion of the railroad rail and rail connector from the placing of concrete. A plurality of cavities are available in the concrete framework adjacent to and extending under the ties and rails. Concrete is then placed over and around the mask 10 and into the cavities in the concrete framework. The concrete is then cured to framework a slab or encasement. The mask 10 is selectively removed after placing or curing of the concrete.

Figure 4:
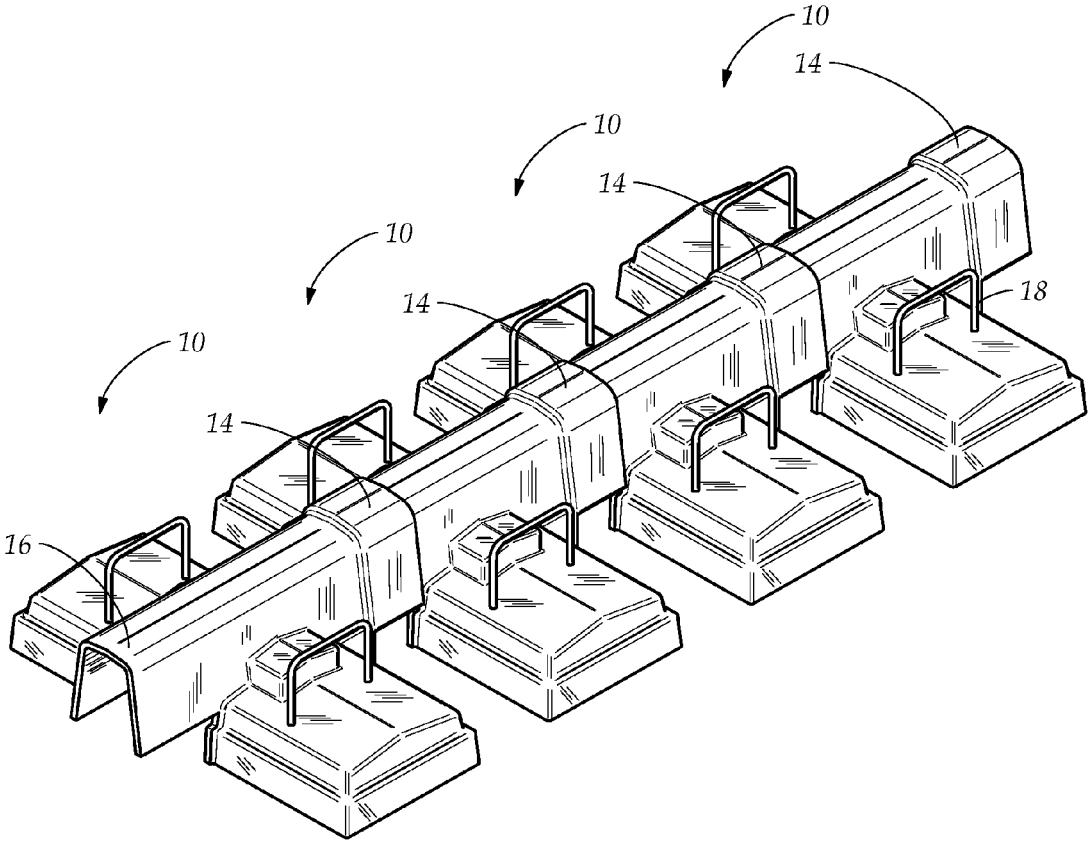
FIG. 4 is diagrammatic perspective view from the top of a plurality of the masks, showing a connecting portion disposed about an extending portion of an adjacent mask to be disposed over a rail.

As shown in FIG. 4, a plurality of masks 10 each has a connecting portion 14 disposed about an extending portion 16 of an adjacent mask 10 disposed over a railroad rail. In this orientation, each mask 10 is configured and disposed to mask the portion of railroad rail extending between adjacent masks.

Figure 5:
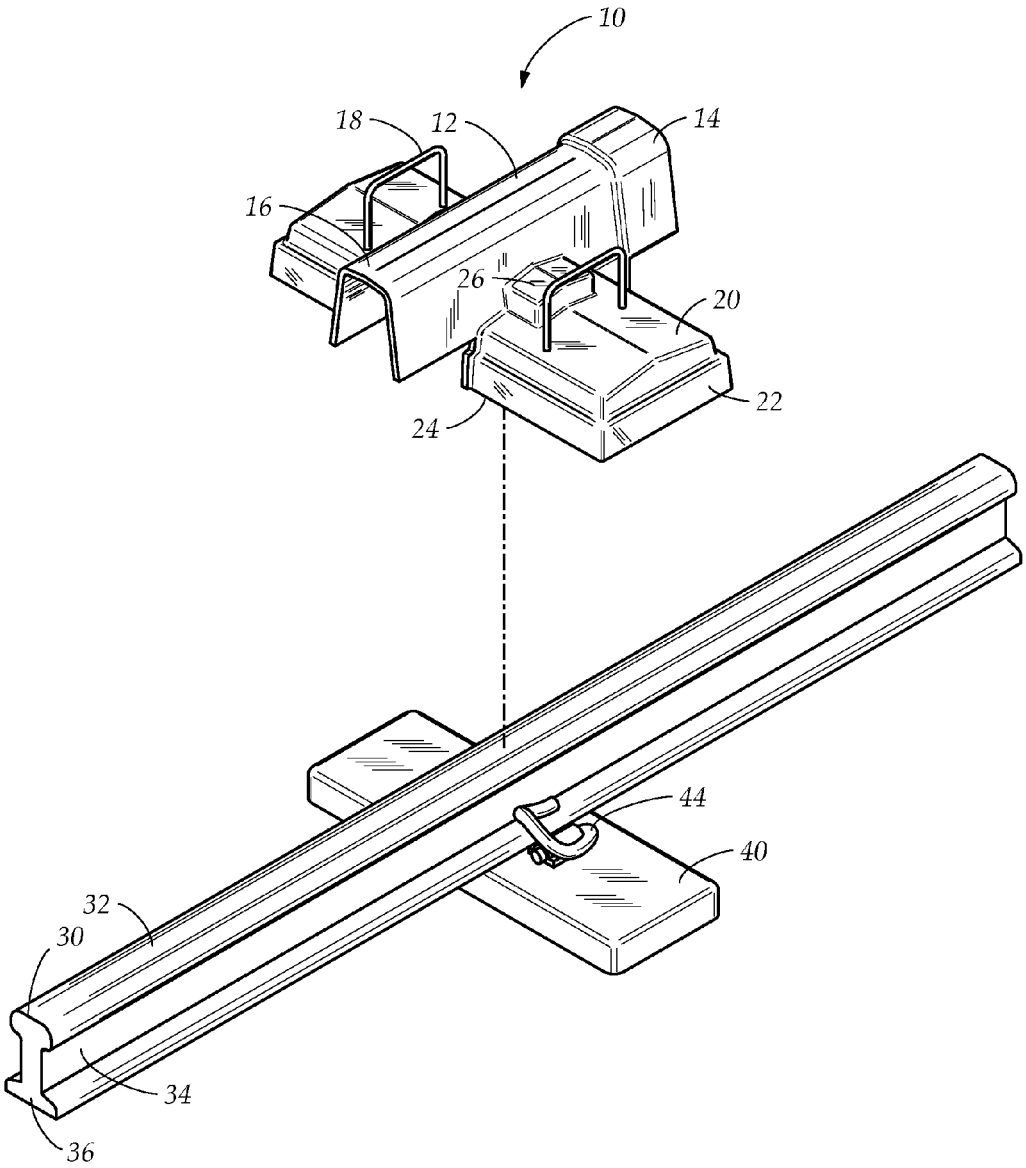
FIG. 5 is diagrammatic perspective view from the top of the mask showing features thereof configured and disposed to mask a portion of the railroad rail, rail connectors, and a base plate, from the placing of concrete while placing.

FIG. 5 shows features of mask 10 configured and disposed to mask a portion of a railroad rail 30, rail connectors 44, and a fastener plate 40, from the placing of concrete into the concrete framework. In this aspect, mask 10 is configured to be disposed to mask a portion of railroad rail 30 and one or more rail connectors 44 from contact with concrete upon the placing of concrete into the concrete framework under and around the railroad rail.

Rail 30 includes rail head 32, base flange 36, and web 34 extending therebetween. The upper portion of rail 30, masked with mask 10, comprises at least rail head 32 and a portion of web 34. Advantageously, mask 10 is configured to mask most all or all of rail 30 from the contact with concrete being poured into the ballast.

Connectors 44 such as rail spikes, lag screws or other connectors as are well known in the art and beyond this discussion. Typically, a connector 44 is disposed proximate each side of rail 30 to hold base flange 36 to fastener plate 40. Fastener plate 40 is attached to a railroad tie with other well-known connectors. Additionally, concrete fastener plate 40 also functions as a railroad tie as it is configured to support rail 30.

FIG. 5 shows mask 10 configured to mask a portion of rail 30, the mask having with connecting portion 14, central portion 12, and extending portion 16. Connector mask portions 26 are configured to mask connectors 44. Perpendicular mask portion 20 is configured to mask the concrete mono-block tie or fastener plate 40. Outer mask portion 22 is configured to mask the outer edges of the concrete mono-block tie or fastener plate 40 extending outward from rail 30. Bottom edge 24 is configured to be selectively disposed with a lower planar surface of the concrete mono-block tie or fastener plate 40 or an alternate desired concrete level.

Figure 6:
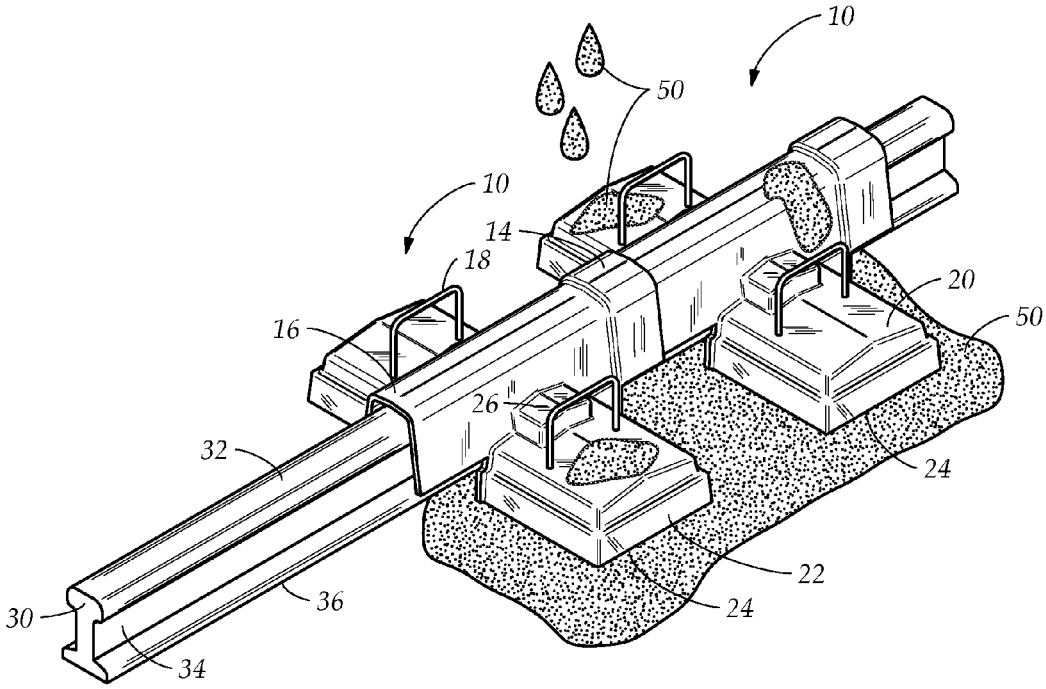
FIG. 6 shows a step of placing concrete about a plurality of masks and wherein one mask has a connecting portion disposed about an extending portion of an adjacent mask.

FIG. 6 shows a step of placing concrete 50 about a plurality of masks 10 and wherein one mask 10 has a connecting portion 14 disposed about an extending portion 16 of an adjacent mask 10. Concrete 50 is poured about masks 10 into the concrete framework in an amount sufficient to contact planar bottom edges 24 of masks 10. Connector mask portions 26 and base plate mask portions 20 is configured to slough off concrete 50 poured thereupon. For example, connector mask portions 26 and base plate mask portions 20 includes sloping upper surfaces. In at least one aspect, mask 10 is substantially void of upper horizontal surfaces upon placing lower edge 24 in a horizontal plane.

Mask 10 includes one or more handles 18 configured to dispose and remove mask 10 about railroad rail 30. Handles 18 are configured to extend above an upper surface of poured concrete 50 allowing grasping and removal of mask 10 after placing of concrete 50.

Figure 7:
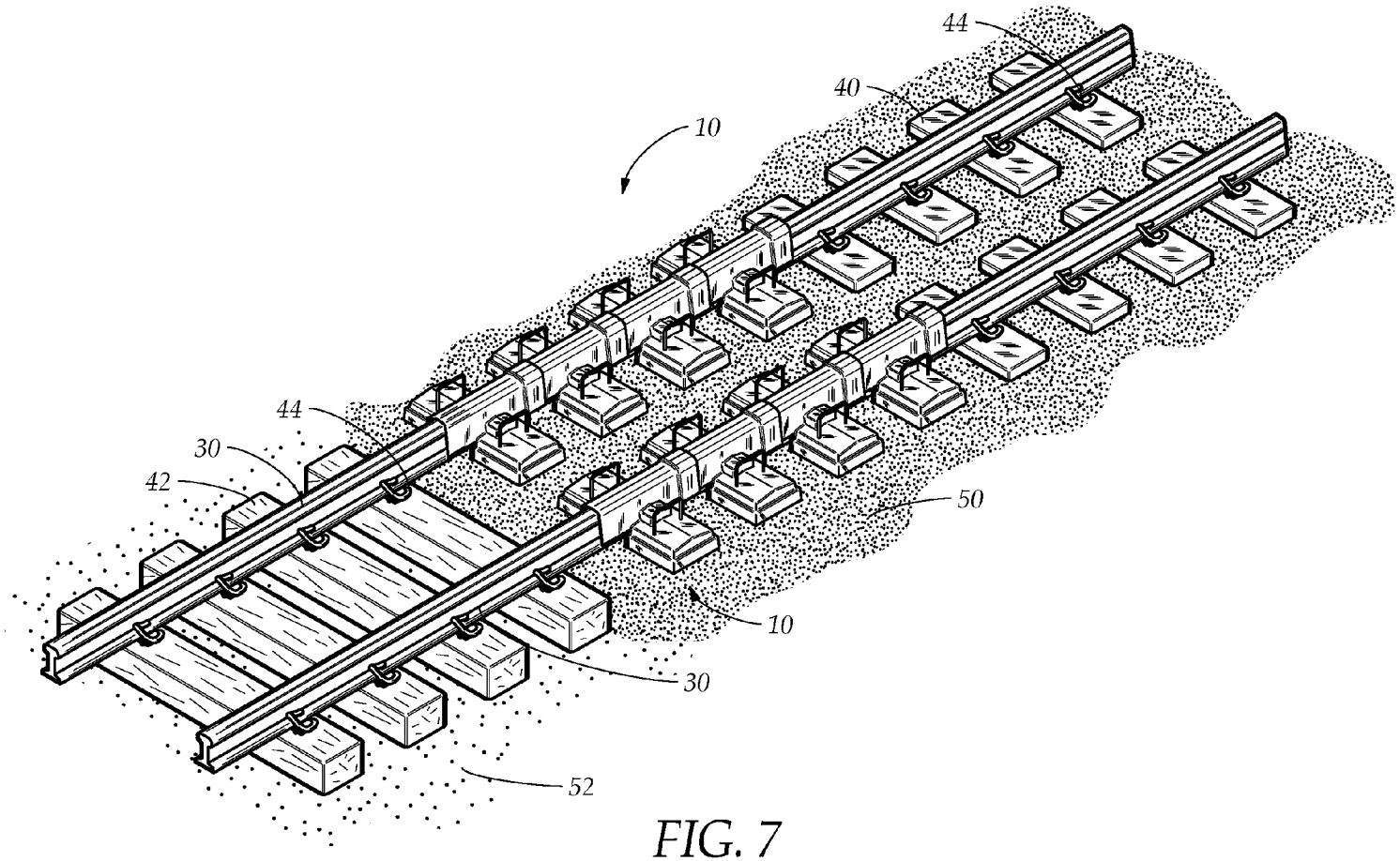
FIG. 7 shows a plurality of masks disposed to mask two parallel lengths of railroad rail and a portion of the railroad tie or base plate extending therebetween.

FIG. 7 shows a plurality of masks 10 disposed to mask two parallel lengths of railroad rail 30 and a portion of the railroad wood tie 42 and concrete mono-block tie or fastener plate 40 extending therebetween. A plurality of masks 10 is disposed about two parallel lengths of railroad rail 30 and masks 10 are configured to mask the concrete mono-block tie or fastener plate 40 extending between the two parallel lengths of railroad rail 30. In this aspect of the present disclosure, concrete is placed over the masks 10 into cavities in the concrete framework, the cavities spanning from one of the two parallel lengths of railroad rail 30 to the other parallel length of railroad rail 30. In at least one aspect, a single mask 10 is configured to cover both parallel rails 30 and railroad tie 42 and selectively the concrete mono-block tie or fastener plate 40 extending therebetween. In one embodiment, the perpendicular portions of a pair of masks are extended and connected by removing the one outer mask portion on each and joining the perpendicular portion thereby to framework a mask capable of covering a wooden tie that extends underneath two parallel rails. Other variations in connecting or extending portions of the mask are possible and are within the inventive concept.

Figure 8A:
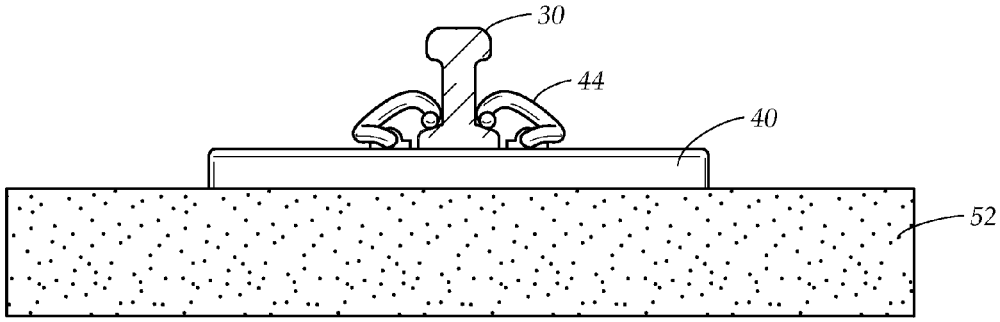
FIG. 8A is a front elevational view of a railroad track with a fastener plate and a concrete framework.
Figure 8B:
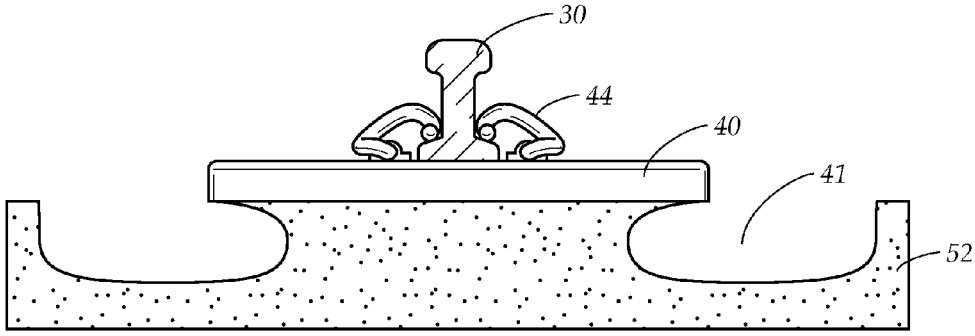
FIG. 8B, similar to FIG. 8A, is a front elevational view of the railroad track with a pair of cavities for receiving concrete.
Figure 8C:
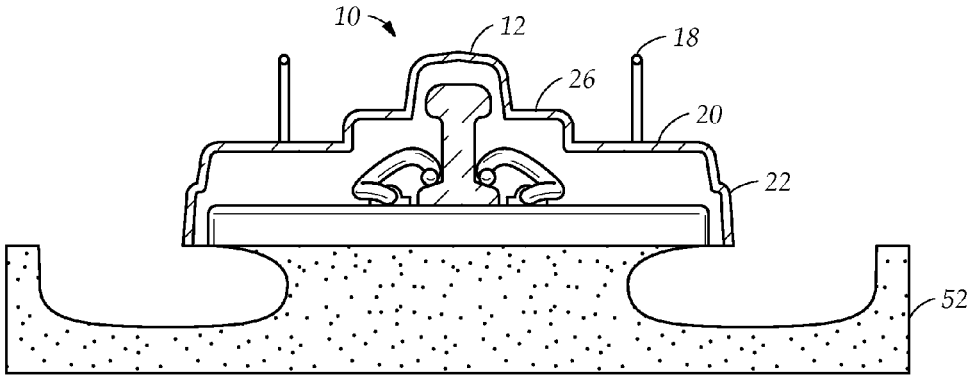
FIG. 8C, similar to FIG. 8B, is a front elevational view of the railroad track with the mask in place.

FIG. 8A through FIG. 8F show method steps for installing the concrete between concrete ties 42. FIG. 8A shows rail 30 supported on the concrete mono-block tie or fastener plate 40 and held therewith with connectors 44. The concrete framework 52 is configured and disposed to receive concrete. In the illustrations, the concrete framework partially filled in with a pair of cavities 52 remaining and available for receiving concrete. The illustrations are understood be non-limiting examples and the cavities in the framework can extend fully under and around the rails. FIG. 8B shows that a portion of the framework 52, adjacent to and below the concrete mono-block tie or fastener plate 40 with cavities 41 available to receive concrete. A mask 10 is disposed over an upper portion of railroad rail 30, rail connectors 44, and concrete mono-block tie or fastener plate 40. In at least one aspect, a mask 10 is disposed to entirely cover upper and outer surfaces of railroad rail 30, rail connectors 44, and concrete mono-block tie or fastener plate 40.

Figure 8D:
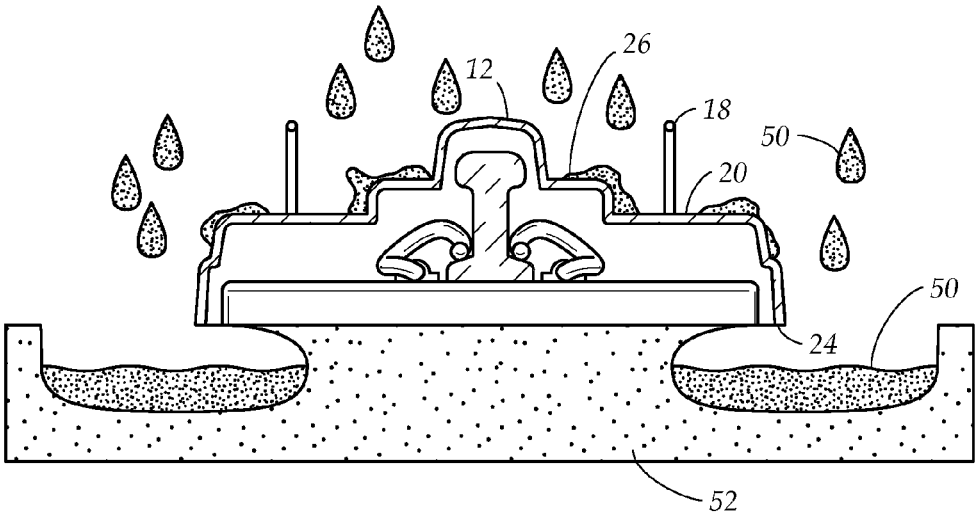
FIG. 8D, similar to FIG. 8C, is a front elevational view of the railroad track with concrete placing into the cavities in the concrete framework over the mask in place.
Figure 8E:
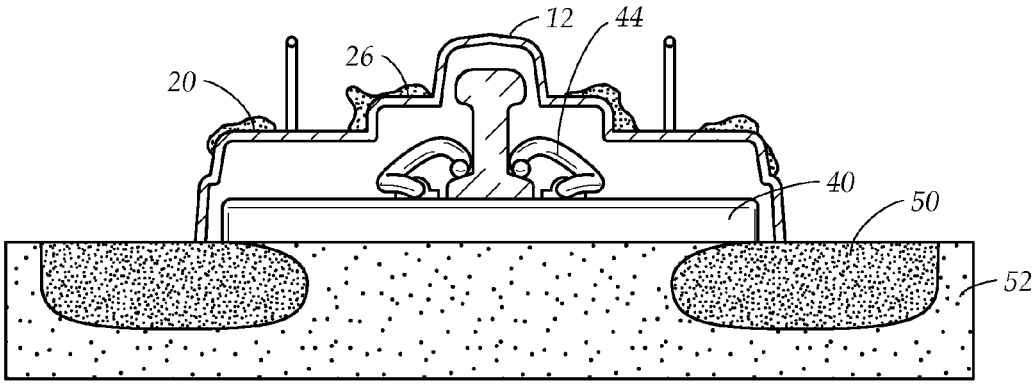
FIG. 8E, similar to FIG. 8D, is a front elevational view of the railroad track with concrete filling the framework with the mask in place.
Figure 8F:
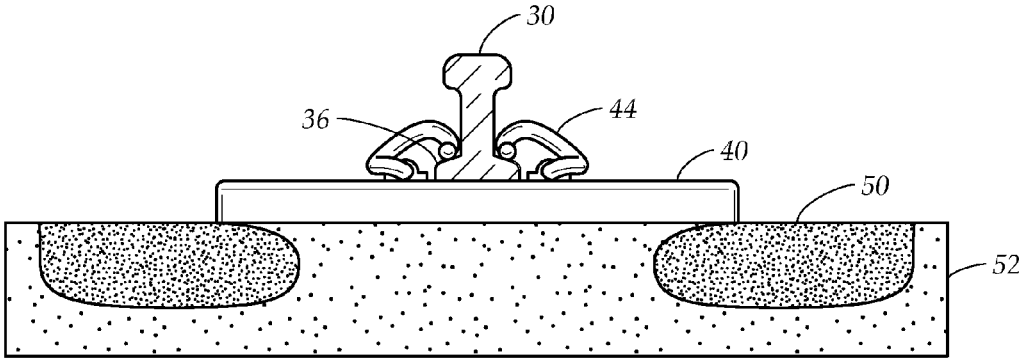
FIG. 8F, similar to FIG. 8E, is a front elevational view of the railroad track with the concrete in place, with the mask removed and the process complete.

FIG. 8D shows the placing of concrete 50 about mask 10, into each cavity 41 in the concrete framework 52 over the mask central portion 12, connector portion and perpendicular portion 20. FIG. 8E shows placing of concrete 50 in an amount sufficient to contact planar bottom edge 24 of mask 10 and fill each cavity 41. FIG. 8F shows the removal of mask 10 from the railroad track and selectively the curing of concrete 50 forming an encasement in the concrete framework 52.

The method steps for covering railroad concrete ties mono-block ties 42 shown in FIG. 8A through FIG. 8F includes disposing a plurality of masks 10 about a length of railroad rail 30 wherein each mask 10 is configured and disposed to mask each base plate 40 and a portion of railroad rail 30 extending between adjacent base plates 40. Each mask 10 includes a planar bottom edge 24 configured to be disposed with a lower planar surface of the tie 40 upon which it is disposed.

It is to be understood that aspects and embodiments of a method and apparatus for installing concrete under and around railroad tracks are disclosed herein and that other and different aspects and embodiments are within the scope of the present disclosure. It is to be understood that one or more aspects disclosed herein, or other aspects, can be incorporated within a single embodiment. For example, in at least one aspect, a single mask can be configured to mask adjacent ties or ties that extend underneath a pair of parallel tracks.

In conclusion, herein is presented a railroad rail and tie covering system including a method and apparatus for installation of direct fixation track, and to a manner of masking portions of a railroad assembly for concrete installation. The invention is illustrated by example in the drawing figures, and throughout the written description. It should be understood that numerous variations are possible, while adhering to the inventive concept. Such variations are contemplated as being a part of the present invention.

What is claimed is:

1. A method of placing concrete around and under a railroad rail, the railroad rail having a concrete framework around and under said railroad rail, the railroad rail being connected to a plurality of ties with a plurality of connectors, said method utilizing a mask configured to be disposed to mask the railroad rail, rail connectors and ties when placing a concrete slab, said method comprising the steps of:

disposing said mask over an upper portion of the railroad rail, rail connectors and tie plates and ties;

placing concrete over and around said mask into the concrete framework, frameworking a concrete slab; and removing said mask from the railroad track, having filled the concrete framework to construct a concrete encasement under and around the railroad track.

2. The method of placing concrete around and under a railroad rail of claim 1, wherein said mask comprises a plurality of masks, each said mask being configured to be disposed to mask the portion of railroad rail extending between adjacent masks, said step of disposing said mask over an upper portion of a railroad rail and rail connector further comprises disposing said plurality of said masks about a length of the railroad rail wherein each said mask is disposed to mask the portion of railroad rail extending between adjacent masks.

3. The method of placing concrete around and under a railroad rail of claim 2, wherein said step of disposing a plurality of masks about a length of railroad rail further comprises disposing a plurality of masks about two parallel lengths of railroad rail.

4. The method of placing concrete around and under a railroad rail of claim 1, wherein said mask comprises at least one handle configured for disposing the mask over the upper portion of the railroad rail and rail connector and removing it therefrom.

5. The method of placing concrete around and under a railroad rail of claim 1, wherein said mask comprises a connecting portion, a central portion, and an extending portion configured to mask an upper longitudinally extending portion of the railroad rail, said connecting portion being configured to be disposed about said extending portion of an adjacent mask disposed over the railroad rail.

6. The method of placing concrete around and under a railroad rail of claim 1, wherein said mask comprises a planar bottom edge.

7. The method of placing concrete around and under a railroad rail of claim 6 wherein said step of placing concrete over and around said mask into the concrete framework further comprises placing concrete in an amount sufficient to contact said planar bottom edge of said mask.

8. A method of installing concrete for supporting a railroad tie, said tie being configured to support a railroad rail and cooperate with rail connectors, said method utilizing a mask configured to be disposed to substantially mask the railroad rail, rail connector, and tie from the placing of concrete, said method comprising the steps of:

disposing said mask over an upper portion of the railroad rail, rail connector, and tie disposed therewith;

placing concrete over and around said mask;

removing the mask from the upper portion of the railroad rail, rail connector, and or tie disposed therewith; and curing the concrete frameworking a concrete slab supporting the railroad tie.

9. The method of installing concrete for supporting a railroad tie of claim 8, wherein said tie is a concrete tie, said method further comprising an initial step of placing a concrete framework under said tie frameworking a cavity therein parallel with the railroad rail supported therewith, and said step of placing concrete over and around said mask and into the concrete framework further comprising placing concrete into each concrete framework.

10. The method of installing concrete for supporting a railroad tie of claim 8, wherein said mask comprises a plurality of masks, each said mask being configured to be disposed to mask each tie and the portion of railroad rail extending between adjacent ties, said step of disposing a mask over an upper portion of the railroad rail, rail connector, and tie disposed therewith further comprises disposing a plurality of masks about a length of railroad rail wherein each said mask is disposed to mask each tie and cooperate with adjacent masks to mask the portion of railroad rail extending between adjacent ties.

11. The method of installing concrete for supporting a railroad tie of claim 8, wherein each said mask comprises at least one handle configured for disposing the mask over the upper portion of the railroad rail, rail connector, and tie disposed therewith and removing it therefrom, after said step of placing concrete about said mask and into the cavities in the concrete framework.

12. The method of installing concrete for supporting a railroad tie of claim 8, wherein said mask comprises a connecting portion, a central portion, and an extending portion configured to mask an upper longitudinally extending portion of the railroad rail, said connecting portion being configured to be disposed about an extending portion of an adjacent mask disposed over the railroad rail.

13. The method of installing concrete for supporting a railroad tie of claim 8, wherein each said mask comprises a planar bottom edge configured to be disposed with a lower planar surface of the base plate or tie upon which it is disposed.

14. The method of installing concrete for supporting a railroad tie of claim 13, wherein said step of placing concrete over and around said mask and into the concrete framework further comprises placing concrete in an amount sufficient to contact said planar bottom edge of each said mask.

* * * * *